United States Patent [19]

Ogawa et al.

[11] 4,451,043

[45] May 29, 1984

[54] GOLF TRAINER

[75] Inventors: Koji Ogawa; Hiroaki Taguchi; Takao Tsutsumi; Yoshinori Yasuda; Akio Takase, all of Gunma, Japan

[73] Assignee: Mitsubishi Denki Kabushiki Kaisha, Tokyo, Japan

[21] Appl. No.: 419,093

[22] Filed: Sep. 16, 1982

[30] Foreign Application Priority Data

| | | | |
|---|---|---|---|
| Sep. 16, 1981 | [JP] | Japan | 56-137219[U] |
| Jan. 21, 1982 | [JP] | Japan | 57-6199[U] |
| Jan. 21, 1982 | [JP] | Japan | 57-6201[U] |

[51] Int. Cl.[3] ..... A63B 69/36

[52] U.S. Cl. ..... 273/186 R; 273/195 A

[58] Field of Search ..... 273/183 A, 186 R, 186 RA, 273/186 A, 186 C, 195 R, 195 A, 195 B; 324/179; 434/252

[56] References Cited

U.S. PATENT DOCUMENTS

| | | | |
|---|---|---|---|
| 2,571,974 | 10/1951 | Walker | 434/252 X |
| 3,024,453 | 3/1962 | Ransom | 324/179 X |
| 3,870,314 | 3/1975 | Bertucci | 273/195 R X |
| 3,880,432 | 4/1975 | Coffey | 273/195 A |
| 3,934,874 | 1/1976 | Henderson | 273/186 C X |
| 3,936,055 | 2/1976 | Scott | 273/195 B X |
| 4,130,283 | 12/1978 | Lindquist | 273/195 A |
| 4,304,406 | 12/1981 | Cromarty | 273/186 R |
| 4,327,918 | 5/1982 | Foster | 273/186 R |

*Primary Examiner*—Harland S. Skogquist

*Attorney, Agent, or Firm*—Sughrue, Mion, Zinn, Macpeak and Seas

[57] ABSTRACT

A golf trainer is provided with sensors arranged in a bifurcated sensor case which is interposed with support portions formed in a base. The base holds the sensor case such that spaces are formed between the sensor case and an overlying shock-resistant material and artificial turf surface. The signals output by the sensors are processed and used to display various information relative to a club swing.

13 Claims, 7 Drawing Figures

GOLF TRAINER

BACKGROUND OF THE INVENTION

The present invention relates to an electronic golf trainer, and, more particularly, to a structure for installing one or more sensors for detecting varied information relative to a golf club head near an impact point.

Golf is an outdoor sport, and it is more frequently practiced outdoors than indoors. While practicing, a mat is put directly on the ground, and a ball is placed on the mat. Under these circumstances, trainer devices are often fouled with dust, rainwater and so on and, therefore, a readily cleanable structure is essential to such trainers. Especially when it is an electronic trainer, circuit components, such as semiconductor elements, sensors and the like, are required to be protected from dust, rainwater and so on, and the facility of cleaning is required to be amply taken into consideration.

It is obvious that in a device including sensors for detecting a golf club head near an impact point, and a display for amplifying the signals and converting them to indicate the distance travelled by a hit golf ball as well as the velocity of the ball and the like, the components, i.e., the sensors, etc., must be reliable over a long period of time to increase the precision of the device.

In the past, an impact or the like caused as by the unsuccessful swing of a golf club head moving at a great speed was not so strong as to destroy the sensors, but affected the installed positions, angular positions or distortion characteristics of the sensors, thus substantially deteriorating the reliability of the device in indicating the aforementioned velocity, distance travelled, etc.

In order to overcome these difficulties, a thick golf mat has been disposed above the sensors. Alternatively, a thick cushion material has been interposed between the sensors and the ball placement position. In either case, the ball carrying portion of the golf trainer is too thick to allow a smooth swing, although the desired thickness is usually some 20 mm.

SUMMARY OF THE INVENTION

In view of the foregoing, it is an object of the present invention to provide a golf trainer which includes a cover, a base for supporting the cover, and one or more sensors installed on the base and separated from the cover by one or more spaces, to thus prevent a blow from the club head from destroying the sensors and to eliminate any variation in the installed positioning of the sensors, thereby assuring long term reliability.

Another object of the present invention is to provide a golf trainer including a case having a plurality of fork-like protrusions, each of which holds one or more sensors therein, a base on which the case is mounted, the base having supports disposed between respective neighboring protrusions, and a cover over which the club head passes, the cover abutting the supports of the base and being separated from the case by one or more spaces, to thus prevent a blow from the club head from destroying the sensors and to eliminate any variation in the state or position of the sensors.

A further object of the present invention is to provide a golf trainer including a closed case structure which contains circuit parts, such as sensors, and a base mat provided with one or more recesses for removably installing the sensor case, thereby facilitating cleaning of the base mat. Specifically, when the base mat is fouled with dust, rainwater or so on, the sensor case is removed and the base mat alone can be washed whole.

DETAILED DESCRIPTION OF THE PREFERRED EMBODIMENTS

Figure 1:
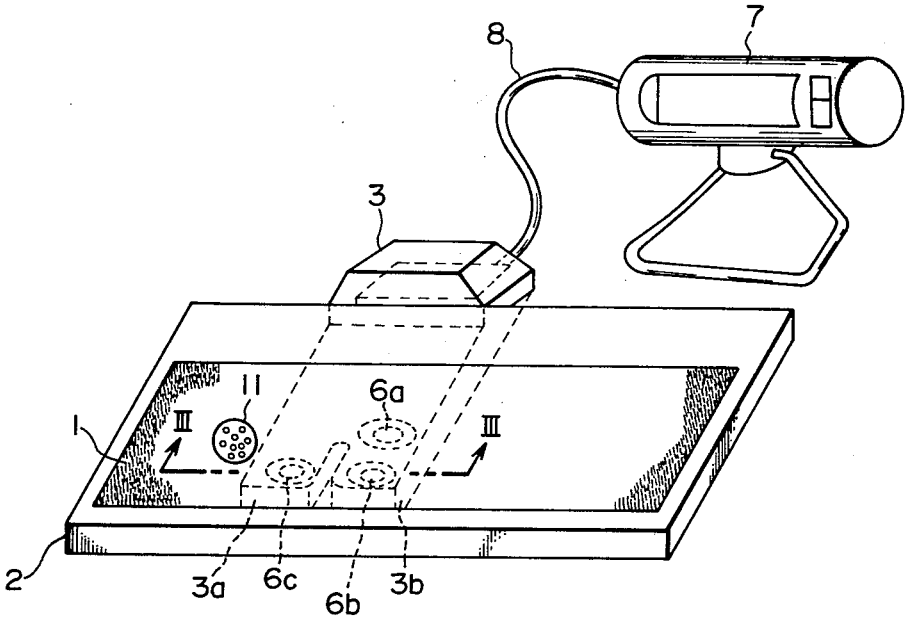
FIG. 1 is a perspective view illustrating one embodiment of a golf trainer of the present invention.
Figure 2:
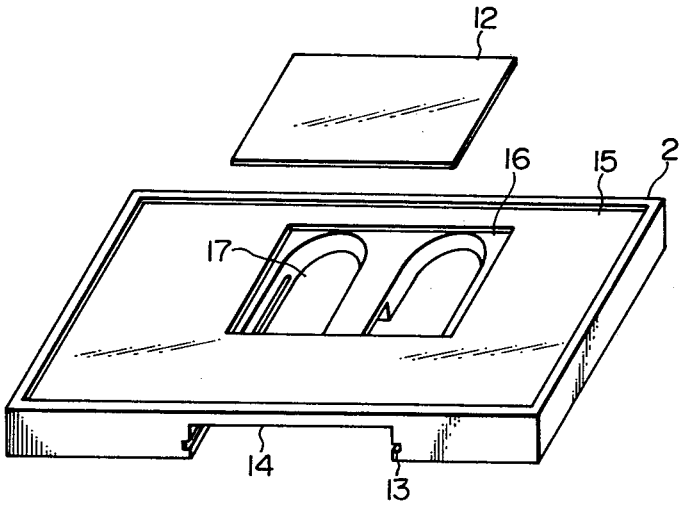
FIG. 2 is a perspective view of the base mat thereof.
Figure 3:
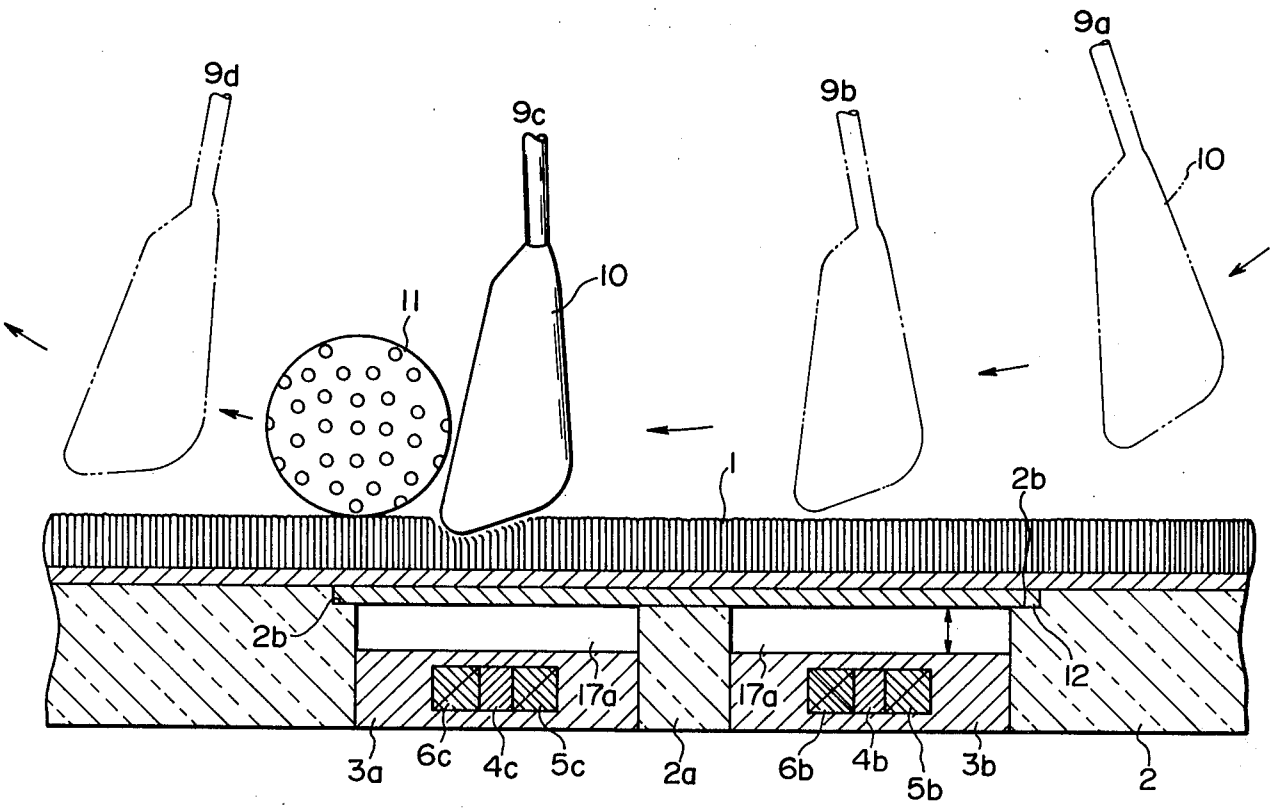
FIG. 3 is a fragmentary enlarged cross sectional view taken along line III—III of FIG. 1.
Figure 4:
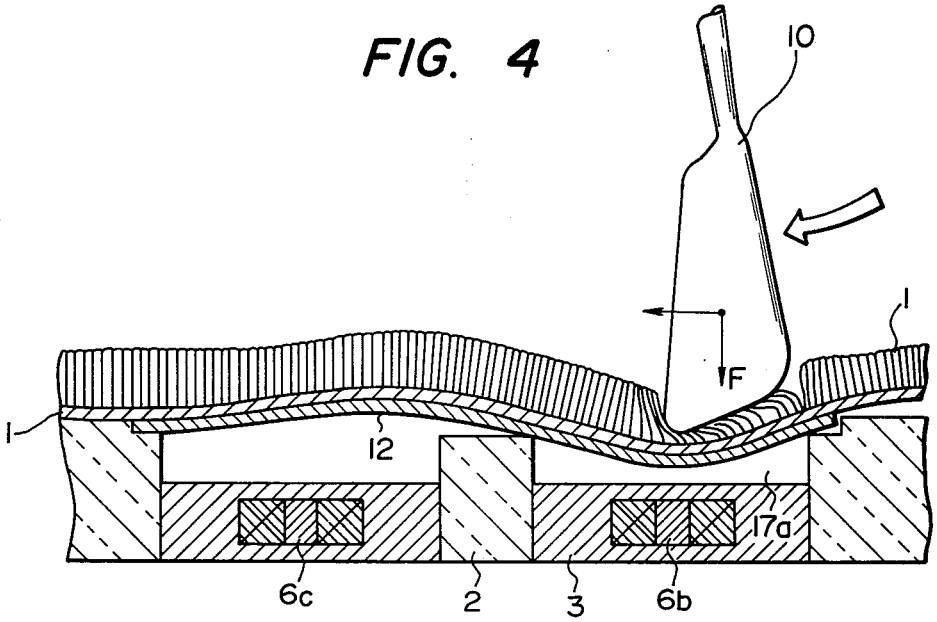
FIG. 4 is a fragmentary enlarged cross sectional view illustrating a deep impact.

Referring to the drawings, there is shown a base mat 2 provided with a recess 14 at its generally central lower portion and a recess 15 at its upper portion. Anchoring grooves 13 are formed on the opposite sides of the recess 14. The base mat also has a recess 16 and openings 17 in respective positions corresponding to sensors 6*a*, 6*b* and 6*c* described hereinafter. Mounted in the recess 15 is a golf mat consisting of artificial lawn, and a sensor case 3 contains an amplifier (not shown) and equally spaced magnetic sensors 6*a*, 6*b* and 6*c*, arranged in fork-like protrusions 3*a*, 3*b*, wherein permanent magnets 4*a*, 4*b* and 4*c* are secured in the respective centers of coils 5*a*, 5*b* and 5*c*. A cover plate 12 consisting of the a polycarbonate material is mounted at a certain distance "d" from the sensor case 3, and protects the sensors from blows from an iron club head 10. Spaces 17*a* and supports 2*a*, 2*b* are provided for protecting the sensors 6*a*, 6*b* and 6c.

Several positions of the club head 10, before and after a golf ball is hit by the head, are indicated by numerals 9*a*, 9*b*, 9*c* and 9*d*. The magnetic sensors 6*a*, 6*b* and 6*c* detect the club head 10, and the resultant signals are amplified by an amplifier (not shown) and fed to a converter (not shown) in a display device 7 through a cable 8 to process and/or perform calculations using the signals for displaying purposes.

In the operation of the structure thus described, as the club head 10 passes over the sensors, the magnetic sensors 6*a*, 6*b* and 6*c* successively produce detection signals depending on the inclination of the club surface, the inclination of its orbit, its velocity, etc., and these signals are suitably processed for display on the display device. For example, the velocity of the club head is derived as follows. As the club head 10 passes over the magnetic sensors 6*b* and 6*c* in succession, the time interval between the detected peaks from the magnetic sensors 6*b* and 6*c* is calculated by counting the number of clock pulses from an oscillation circuit such as a crystal oscillator. Then a constant value, which is set by taking the distance between the magnetic sensors 6*b* and 6*c* and the reaction of the club head 10 relative to the golf ball 11 into consideration, is divided by the time interval above to obtain the velocity.

When the golf club is an iron, unsuccessful swings usually accompanied by a rubbing or scraping of the ground are unavoidable. At this time an impulsive force from the club head is supplied to the golf mat 1 as a pressure F, but is not directly transmitted to the magnetic sensors 6a, 6b and 6c, because the golf mat 1, cover 12 and supports 2a, 2b disperse the absorb such pressure. Further, the presence of the spaces 17a also hinders transmittance of the pressure. Furthermore, the elasticity of the cover plate 12, being supported at short intervals, is such that the deformations of the mat 1 and plate 12 are relatively small. Also, the distance "d" across spaces 17a is selected so that the maximum impulsive force assumed in this embodiment is unable to bring the cover plate 12 into direct contact with the sensor case 3, and therefore the sensors are perfectly protected. Polycarbonate, which is selected as the material of the cover plate, is superior in magnetic permeability, shock resistance and elasticity and, accordingly, it can absorb shock effectively and does not damage even after repetitive shocks. Shock due to a mis-hit by the club head 10 is effectively absorbed by the gold mat 1 and cover plate 12, and is not transmitted to the sensors with the result that relative motion among the sensors is prevented. Especially when magnetic sensors are used, as in this embodiment, relative motion among the sensors tend to produce false readings. However, such phenomenon is prevented in the present device, where the sensor case 3 is neither impacted indirectly or directly to preclude distortion and, of course, destruction of the sensor case 3.

Figure 5:
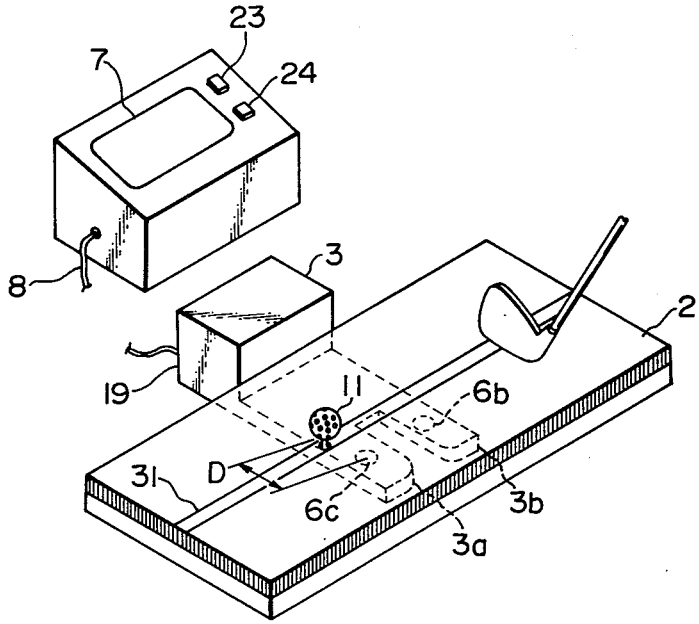
FIG. 5 is a perspective view of a second embodiment of golf trainer according to the present invention.
Figure 6:
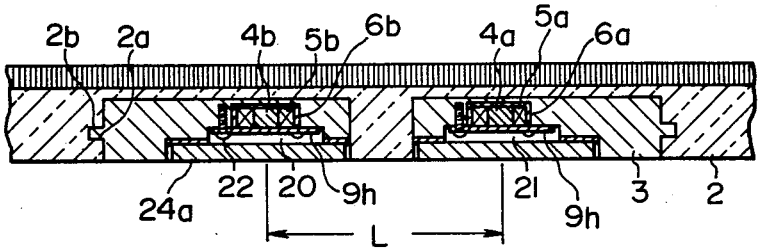
FIG. 6 is a sectional view of the principal part of FIG. 5.
Figure 7:
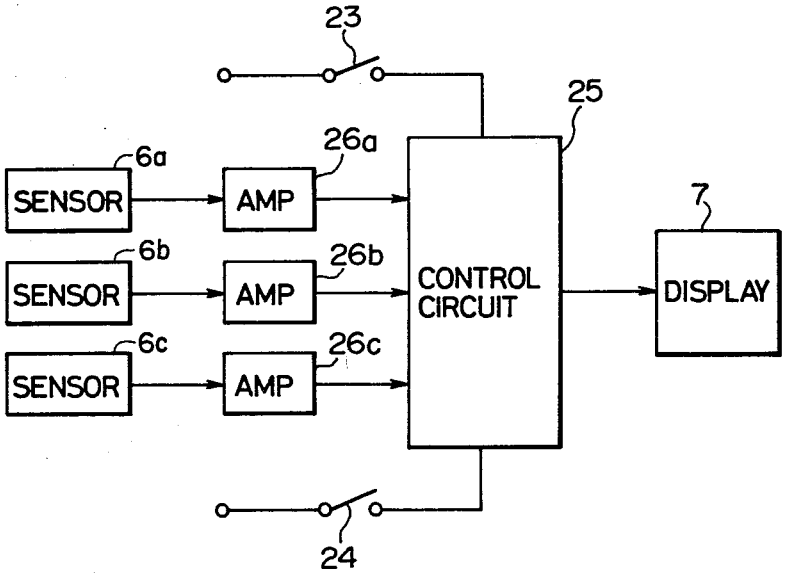
FIG. 7 is a block diagram of the electric circuit.

FIGS. 5–7 illustrate another embodiment of the present invention, and in which there are shown the body of a golf trainer having a control circuit 25 described later, a display portion 7, a power switch 23, a club selecting key 24, a signal line 8, a base mat 2 provided with a lawn-like portion on its upper portion and which has recesses 2b for insertion of engaging portions 2a. A white line 31 is drawn on the center of the upper surface of the base mat for indicating the direction of swing of the club head. A tee stands on the center of the white line 31 on the base mat, and a golf ball (which is not necessarily required) is placed on the tee. Signal generating magnetic sensors 6a, 6b and 6c and a sensor case 3 are removably attached to the base mat. The magnetic sensors 6a, 6b and 6c comprise respective permanent magnets 4a–4c, coils 5a–5c wound with a predetermined number of turns on the magnets, an electroconductive case 9h containing the magnets, and molded resin loaded within the case as a separator. The sensor case 3 has a box-like portion 19 containing the first stage amplifiers 26a, 26b and 26c (described later) at one end and a pair of fork-like protrusions 3a and 3b at the other end. The protrusions have engaging convexities 2b on both sides. The magnetic sensors 6c and 6b, forming a pair, are installed in recesses 20 formed on opposite sides with respect to the center line of the swing orbit near the tee, which is on the back side of the protrusion 3a, at a given internal of D/2, for example 25 mm, from the center line with screws 22. The magnetic sensor 6a is installed in a recess 21 formed on the back side of the protrusion 36 at a distance L, for example 50 mm, from the magnetic sensor 6b, when measured in the direction toward the entry side of the club head 12, with screws 22. A covering 24a covers the magnetic sensors 6a, 6b and 6c water-tightly, in cooperation with seals.

Referring to FIG. 7, which is a block diagram of the present invention, signals indicative of the moving state of the club head detected at the sensors 6a, 6b and 6c are amplified by first stage amplifiers 26a, 26b and 26c installed near the sensors (in this example, within the box-like portion 19) by a given factor as the signals are very small, and the signals are then applied to the control circuit 25, which arithmetically calculates (1) the velocity of the club head, (2) the distance travelled by the ball, and (3) the offset angle of the face, and applies the results to the display portion 7 for display purposes. In the operation of the structure described above, when it is placed directly on the ground outdoors for training purposes, the base 2, sensor case 3 and body may be made considerably dirty. Especially, the base mat tends to be severly fouled with dust. Unfortunately, such dust, especially that which has entered the lawn-like portion and so on, cannot be readily removed with a cloth or the like. The best method for thoroughly removing such dust is to wash the mat in water. In this embodiment, the sensor case 3 holding the electronic parts is removed from the base mat, and then the base mat is as a unit thoroughly washed with water. The sensor case 3 having small outer dimensions and holding the electronic parts therein requires only cleaning with a cloth or the like and, therefore, the devices can be readily restored to their original states without deteriorating the performance thereof. When the trainer is used, the sensors can be accurately located by merely aligning the protrusions and recesses 2a, 2b and inserting the protrusions into their corresponding recesses to insert the sensor case 3 into the recess 14 in the base 2.

It is also noted that as described, the sensors are included in a sensor case 3, which in turn is inserted in the base mat 2. Alternatively, the sensors may be included, for example, in a base integral with both the case 3 and mat 2.

Although the above embodiment refers to three magnetic sensors, the number is not so limited. Also, any detecting means, such as a photosensor, a Hall effect element, ultrasonic detector means, etc. capable of detecting a golf club head near an impact point may be used.

Thus, by providing a cover, a base supporting the cover, and one or more sensors installed on the base and separated from the cover by one or more definite spaces in accordance with the present invention, a golf trainer can be produced which is characterized in that it has a thin base and prevents a bad swing of the club head from applying a great shock to the sensors. Therefore, destruction of the sensors is prevented, assuring long term reliability.

Moreover, by providing a case having a plurality of fork-like protrusions, each of which holds one or more sensors therein, a base mounting the case and having supports disposed between respective neighboring protrusions, and a cover on which the club head passes, the cover abutting the supports of the base and being separated from the case by one or more definite spaces, in accordance with the present invention, a golf trainer can be produced which has great advantages in that it can prevent a blow from destroying the case and the sensors and eliminate any variation of the installed position of the sensors.

What is claimed is:

1. A golf trainer, comprising:

a base on which a golf ball is placed, one or more sensors installed in said base for detecting the moving state of a swinging club head to produce output signals, means for receiving said detected output signals and processing these signals to display the same as various information relative to the club swing, a sensor case distinct from said base for holding said sensors in position therewithin, and one or more recesses formed in said base for removably installing said sensor case therein.

2. A golf trainer as set forth in claim 1, wherein said sensor case is so installed that it is separated from an upper plate of said base by one or more definite spaces.

3. A golf trainer as set forth in claim 1, wherein said sensor case consists of a portion containing amplifiers for amplifying the signals from the sensors and another portion containing the sensors, and wherein only said another portion is installed in any one of the recessions.

4. A golf trainer as set forth in claim 1, wherein said base includes an upper member supporting lawn-like material.

5. A golf trainer as set forth in claim 1, wherein each of said sensors is a magnetic sensor.

6. A golf trainer as set forth in claim 1, wherein said base includes an upper plate provided with a hole communicating with said recesses, and an elastic material having shock-resistant characteristics overlying said hole, wherein the sensor case is installed such that spaces are formed between said elastic material and said sensor case.

7. A golf trainer as set forth in claim 1, wherein said base includes one or more compartment portions arranged joining said recesses in a direction perpendicular to the direction of the recesses, and wherein said sensor case includes fork-like protrusions each containing at least one sensor and installed such that the protrusions underly said compartment portions.

8. A golf trainer as set forth in claim 1, wherein said recesses include side walls provided with anchoring grooves, and said base having one or more compartment portions overlying each recess at a position at which the sensor case is inserted and in a direction perpendicular to the direction of the recesses, and wherein said sensor case includes fork-like protrusions provided with side walls having protuberances for engaging said anchoring grooves, each of said protrusions holding at least one sensor therein, said sensor case being installed such that said protuberances engage said anchoring grooves and underly said compartment portions.

9. A golf trainer as set forth in claim 1, wherein said base includes an upper plate provided over a hole communicating with said recesses and formed of an elastic material having shock-resistant characteristics, said base being provided with supports between and on either side of said recesses each of which upholds said elastic material and compartmentalizes each recess in a direction in which said sensor case is inserted and in a direction perpendicular to said direction, said sensor case being provided with fork-like protrusions each holding at least one sensor therein and being installed such that said protrusions interengage said supports and such that at least one space is formed between said elastic material and said sensor case.

10. A golf trainer as set forth in claim 9, wherein said elastic material having shock-resistant characteristics is a polycarbonate material.

11. A golf trainer, comprising;

a base on which a lawn-like material is laid, said base having a sunken concave upper surface, and a recess for installing a sensor case, support means in said recess for compartmentalizing said recess in a direction in which said sensor case is inserted and in a direction perpendicular to said direction, and for supporting a shock-resistant elastic material, said upper surface being provided with a hole communicating with said recess, said shock-resistant elastic material being laid over said hole, a first fork-like portion containing at least one sensor for detecting the state of a swinging club head to produce output signals, and a second portion containing amplifiers for amplifying the signals from said sensors, said recess holding a sensor case, said sensor case being removably installed such that only said first portion interengages said support means in said recess, spaces formed between said shock-resistant elastic material and said sensor case, and a display portion receiving said signals from said sensors and arithmetically processing said signals for displaying the same as various information relative to said swing.

12. A golf trainer, comprising:

a base on which a lawn-like material is laid, said base having a sunken concave upper surface, and a recess for installing a sensor case therein, said recess being provided with anchoring grooves, a supporting portion in said recess for compartmentalizing said recess in a direction in which said sensor case is inserted and for supporting a polycarbonate material, said upper surface being provided with a hole communicating with said recess, said polycarbonate material overlying said hole, a first fork-like portion containing at least one magnetic sensor for detecting said moving state of a swinging club head to produce output signals, a second portion containing amplifiers for amplifying said signals from said magnetic sensors, said first fork-like portion having protrusions for engaging said anchoring groove in said recess, said sensor case being removably installed such that said first portion is interposed with said supporting portion in said recess and such that spaces are formed between said polycarbonate material and said sensor case, a display portion for receiving said signals from said magnetic sesnors for arithmetically processing these signals for display the same as various information relative to said swing.

13. A golf trainer, comprising:

a base on which a ball is placed, at least one sensor installed in the base for detecting the moving state of a swinging club head to produce output signals, a circuit for receiving said output signals and arithmetically processing said signals to produce data, a display portion for receiving and displaying said data as various information relative to said swing, and a sensor case distinct from said base for locating said sensors in position therewithin, said base being provided with one or more recesses for removably installing said sensor case therein.

* * * * *